US012037785B2

(12) United States Patent
Cakir Aydogan et al.

(10) Patent No.: US 12,037,785 B2
(45) Date of Patent: Jul. 16, 2024

(54) SOUND-DATA-INTERACTIVE DYNAMIC ADAPTIVE FACADE MODULE SYSTEM

(71) Applicant: ISTANBUL TEKNIK UNIVERSITESI, Istanbul (TR)

(72) Inventors: Oznur Cakir Aydogan, Izmir (TR); Meltem Aksoy, Istanbul (TR)

(73) Assignee: OZNUR CAKIR MIMARLIK MUHENDISLIK INSAAT TURIZM SAN VE TIC LTD, Izmir (TR)

( * ) Notice: Subject to any disclaimer, the term of this patent is extended or adjusted under 35 U.S.C. 154(b) by 241 days.

(21) Appl. No.: 17/760,792

(22) PCT Filed: Sep. 15, 2020

(86) PCT No.: PCT/TR2020/050841
§ 371 (c)(1),
(2) Date: Mar. 16, 2022

(87) PCT Pub. No.: WO2021/054919
PCT Pub. Date: Mar. 25, 2021

(65) Prior Publication Data

US 2022/0341158 A1 Oct. 27, 2022

(30) Foreign Application Priority Data

Sep. 16, 2019 (TR) ..... 2019/14039

(51) Int. Cl.
*E04B 1/00* (2006.01)
*E04B 1/344* (2006.01)
*E04B 1/99* (2006.01)

(52) U.S. Cl.
CPC ..... *E04B 1/994* (2013.01); *E04B 1/344* (2013.01)

(58) Field of Classification Search
CPC . E04B 1/941; E04B 1/99; E04B 1/994; E04B 2/00; E04B 1/344
See application file for complete search history.

(56) References Cited

U.S. PATENT DOCUMENTS 8,528,621 B2 * 9/2013 Murphy, Jr. ..... E04F 10/10 49/80.1
10,461,684 B1 * 10/2019 Rubin ..... H02S 20/24
(Continued)

FOREIGN PATENT DOCUMENTS

KR 101602724 B1 3/2016
WO 0197202 A1 12/2001
WO 2017139968 A1 8/2017

OTHER PUBLICATIONS

Oznur Cakir Aydogan, A Dynamic Adaptive Facade Proposal With Sound Data Interaction—Sound Shield, Istanbul Technical University, 2018, pp. 1-160.

*Primary Examiner* — Chi Q Nguyen
(74) *Attorney, Agent, or Firm* — Bayramoglu Law Offices LLC

(57) ABSTRACT

A sound-data-interactive dynamic adaptive facade module system is provided. The sound-data-interactive dynamic adaptive facade module system changes a shape of the sound-data-interactive dynamic adaptive facade module system by moving interactively according to sound values and by gaining a sound shield feature by enlarging a surface. The sound-data-interactive dynamic adaptive facade module system includes: a steel frame structure, a coating material, a vertical steel carrier profile, a coupler, a vertical and horizontal steel carrier joint profile, a metal pinion plate, a bearing, a bush cap, a servo motor, and servo motor connection cables.

3 Claims, 16 Drawing Sheets

(56) References Cited

U.S. PATENT DOCUMENTS

| | | | | |
|---|---|---|---|---|
| 10,526,770 | B2 * | 1/2020 | Valinejadshoubi | E06B 9/24 |
| 10,601,363 | B1 * | 3/2020 | Rubin | H02S 20/23 |
| 10,662,703 | B2 * | 5/2020 | Ghanizadehgrayli | F24F 11/0001 |
| 10,724,291 | B2 * | 7/2020 | Tabadkani | E06B 9/24 |
| 11,349,431 | B1 * | 5/2022 | Cerullo | H02S 20/23 |
| 2010/0193013 | A1 * | 8/2010 | Kong | H02S 20/30 136/251 |
| 2010/0243023 | A1 * | 9/2010 | Patton | F24S 25/61 136/244 |
| 2017/0229997 | A1 * | 8/2017 | Van Otten | H02S 20/23 |
| 2018/0119481 | A1 * | 5/2018 | Ghanizadehgrayli | F24F 13/28 |
| 2018/0216399 | A1 | 8/2018 | Tabadkani et al. | |
| 2022/0127843 | A1 * | 4/2022 | Krarti | F28D 20/02 |
| 2022/0246126 | A1 * | 8/2022 | Headley | E04B 1/99 |

* cited by examiner

| Sound Pressure-Dp | Noise Level | Pinion Rotation Angles |
|---|---|---|
| 0 | Low | 90.00 |
| 5 | Low | 86.79 |
| 10 | Low | 83.57 |
| 15 | Low | 80.36 |
| 20 | Low | 77.14 |
| 25 | Low | 73.93 |
| 30 | Low | 70.71 |
| 35 | Medium | 67.50 |
| 40 | Medium | 64.29 |
| 45 | Medium | 61.07 |
| 50 | Medium | 57.86 |
| 55 | Medium | 54.64 |
| 60 | Medium | 51.43 |
| 65 | Medium | 48.22 |
| 70 | High | 45.00 |
| 75 | High | 41.79 |
| 80 | High | 38.57 |
| 85 | High | 35.36 |
| 90 | High | 32.12 |
| 95 | Very High | 28.93 |
| 100 | Very High | 25.72 |
| 105 | Very High | 22.50 |
| 110 | Very High | 19.29 |
| 115 | Very High | 16.07 |
| 120 | Very High | 12.86 |
| 125 | Very High | 9.65 |
| 130 | Very High | 6.43 |
| 135 | Very High | 3.22 |
| 140 | Very High | 0.00 |

FIG. 14

SOUND-DATA-INTERACTIVE DYNAMIC ADAPTIVE FACADE MODULE SYSTEM

CROSS REFERENCE TO THE RELATED APPLICATIONS

This application is the national stage entry of International Application No. PCT/TR2020/050841, filed on Sep. 15, 2020, which is based upon and claims priority to Turkish Patent Application No. 2019/14039, filed on Sep. 16, 2019, the entire contents of which are incorporated herein by reference.

TECHNICAL FIELD

The invention relates to a sound-data-interactive dynamic adaptive facade module system that interactively changes shape according to sound-data and gains sound barrier features by expanding the surface area.

BACKGROUND

In architecture, the term adaptive describes a building that adapts itself to environmental factors, to the user, changes or transforms according to the properties of the material or its moving components and its environment. In other words, it is the adaptation of the entire building, a part of the building or the components of the building to its environment as the result of analyzing the incoming data to increase its performance.

In adaptive architecture, a building having movable components or the ability to move, can have a performance-enhancing role according to the quality of the factor. Concordantly, the concept of "motion" in architecture has passed through various development processes since the invention of the wheel and its use, which adds different qualities to buildings. The notion of motion in architecture has gained ground from different walks of life as enabling other conditions in humans' lives.

The concept of "kinetics" is frequently used in architecture to describe a situation that basically comprises motion. It means the structure or the components that have the ability to move. Generally, the "kinetics" describes the ability of a system to move.

William Zuk and Roger H. Clark have initially put forward the idea to adapt movable structure components to architectural design in 1970. They interpreted the kinetics architecture as technology adapting to changes taking place in the affecting-conditions and mediating the interpretation and application of these conditions. Kinetic architecture has a multi-disciplinary study and research environment. The development process of the components of kinetic architecture has accelerated thanks to the different materials produced by means of rapid development of technology.

Kinetic systems are important since they increase the alternatives and the adaptation performance of the reaction mechanism. Adaptive systems that can adapt to the environment more easily have been produced with the movable structures developed from light, flexible, self-transforming materials.

Various developments such as sound-data-interactive dynamic adaptive facade module systems, have been introduced in the art.

The KR101602724B1 numbered Korean patent document in the prior art mentions an experimental kinetic interactive architectural system structured by integrating the digital structure technology represented as microcontroller and robotics into building technology, especially with the developments in architectural technology and innovative digital technology. The mentioned system comprises a siding, ropes pulling the siding, and motors. Kinetic interactive architecture is attained via a motor moving the siding upon receiving the music from the outside by a sound receiver and processing it with a microprocessor.

The WO2017139968A1 numbered European patent document in the prior art mentions a noise controlled technical field. In particular, in the document, a hyperbolic cooling tower muffling system that can prevent the propagation of noise from a wet cooling tower that has a counter-current to the large hyperbolic natural ventilation is mentioned.

The WO0197202A1 numbered International patent document in the prior art mentions a movable outer surface imaging system. The document mentions that the subject system comprises pneumatic pistons, electric step-servo systems, and hydraulic pistons. A mechanical actuator that can be used for moving the screen in and out on the coating surface has been provided. Thus, the mechanical actuator can move pneumatically, hydraulically, or electrically on its own. The electronic control system controls the physical imaging apparatus, obtains the position information, and thereby controls the motion models of the surface effectively. The motion mode is interpreted according to the data obtained from the output signal. The rotation frequency of the pistons can be adjusted using an image-controlled variable.

However, the systems in the prior art do not gain changeable features according to different sound-values, as well as not perceiving the sound-values.

The sound-data-interactive dynamic adaptive facade module system subject to the invention is developed to solve the problems mentioned above.

SUMMARY

The aim of this invention is to develop a sound-data-interactive dynamic adaptive facade module system that perceives the sound-values and adapts to the environment more quickly and flexibly with its kinetic structure.

Another aim of the invention is to develop a sound-data-interactive dynamic adaptive facade module system that minimizes cardiovascular diseases that are caused by noise.

Another aim of the invention is to develop a sound-data-interactive dynamic adaptive facade module system that can reduce high pressure on building facades in high-noise areas using the facade module that increases the individual health levels.

Another aim of the invention is to develop a sound-data-interactive dynamic adaptive facade module system that has the feature to be used according to changeable sound performances by being integrated into conference rooms, auditoriums, opera halls, and concert halls of different sizes.

BRIEF DESCRIPTION OF THE DRAWINGS

The sound-value-interactive dynamic adaptive facade module system that has been carried out in order to reach the aims of the invention has been illustrated in the attached figures.

The figures have been described below;

FIG. 14: The table of the pinion rotating angles encoded in the software according to the sound pressure level of the system subject of the invention.

Figure 1A:
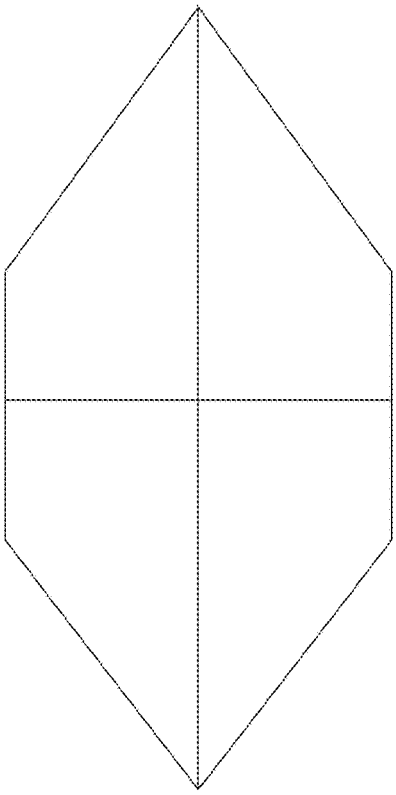
FIG. 1A: The view of the geometry of the sound shield module of the system subject of the invention.
Figure 1B:
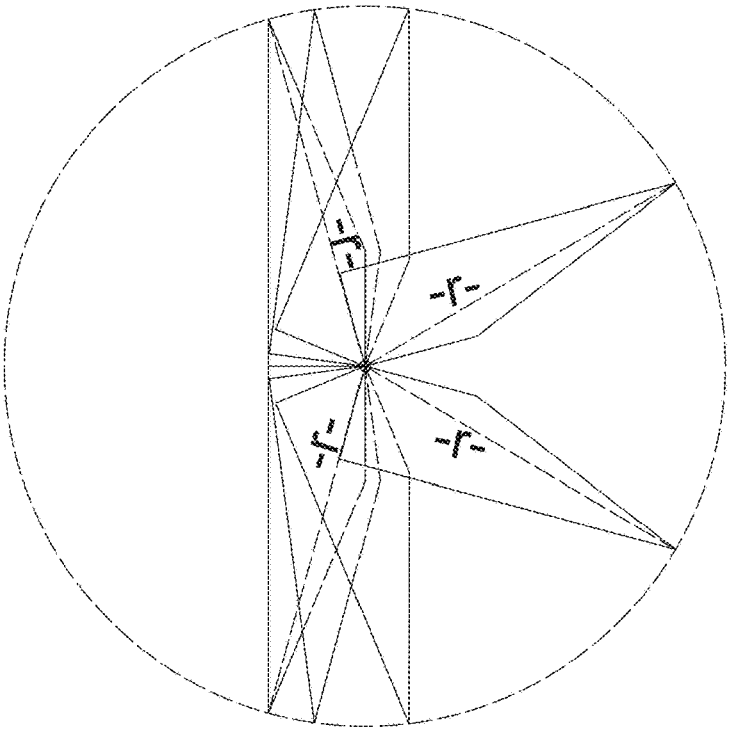
FIG. 1B: The diagram view of the sound shield module of the system subject of the invention.
Figure 2A:
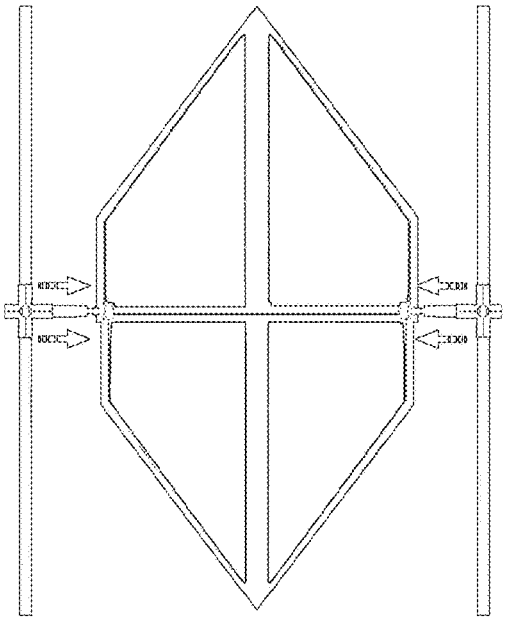
FIG. 2A: The very high-frequency (90-140 dB) noise level view of the sound shield module of the system subject of the invention.
Figure 2B:
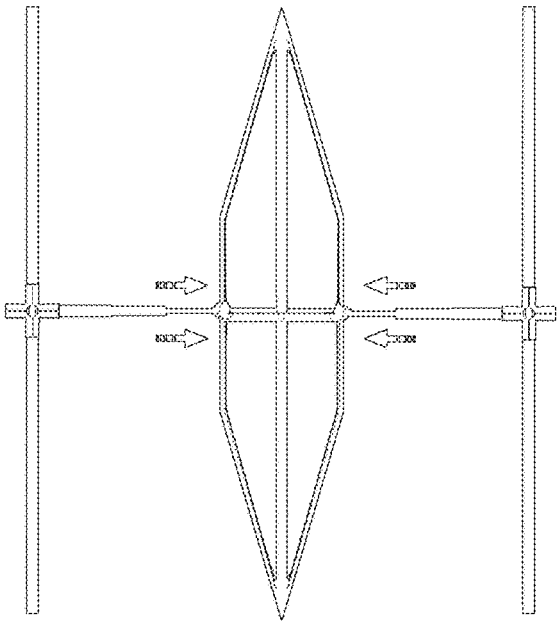
FIG. 2B: The high-frequency (65-90 dB) noise level view of the sound shield module of the system subject of the invention.
Figure 2C:
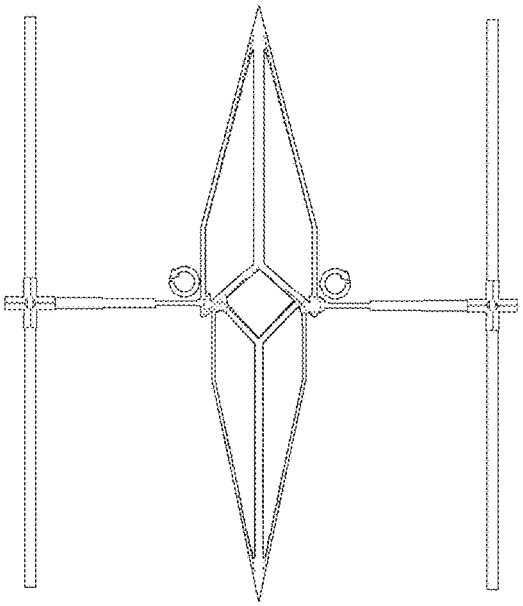
FIG. 2C: The moderate-frequency (30-65 dB) noise level view of the sound shield module of the system subject of the invention.
Figure 2D:
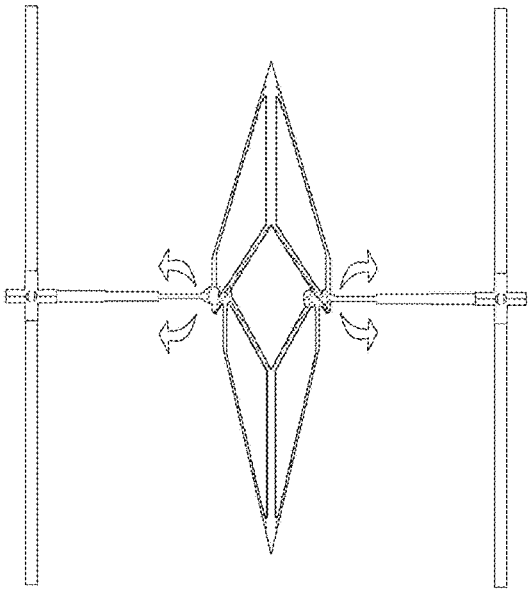
FIG. 2D: The low-frequency (0-30 dB) noise level view of the sound shield module of the system subject of the invention.
Figure 3:
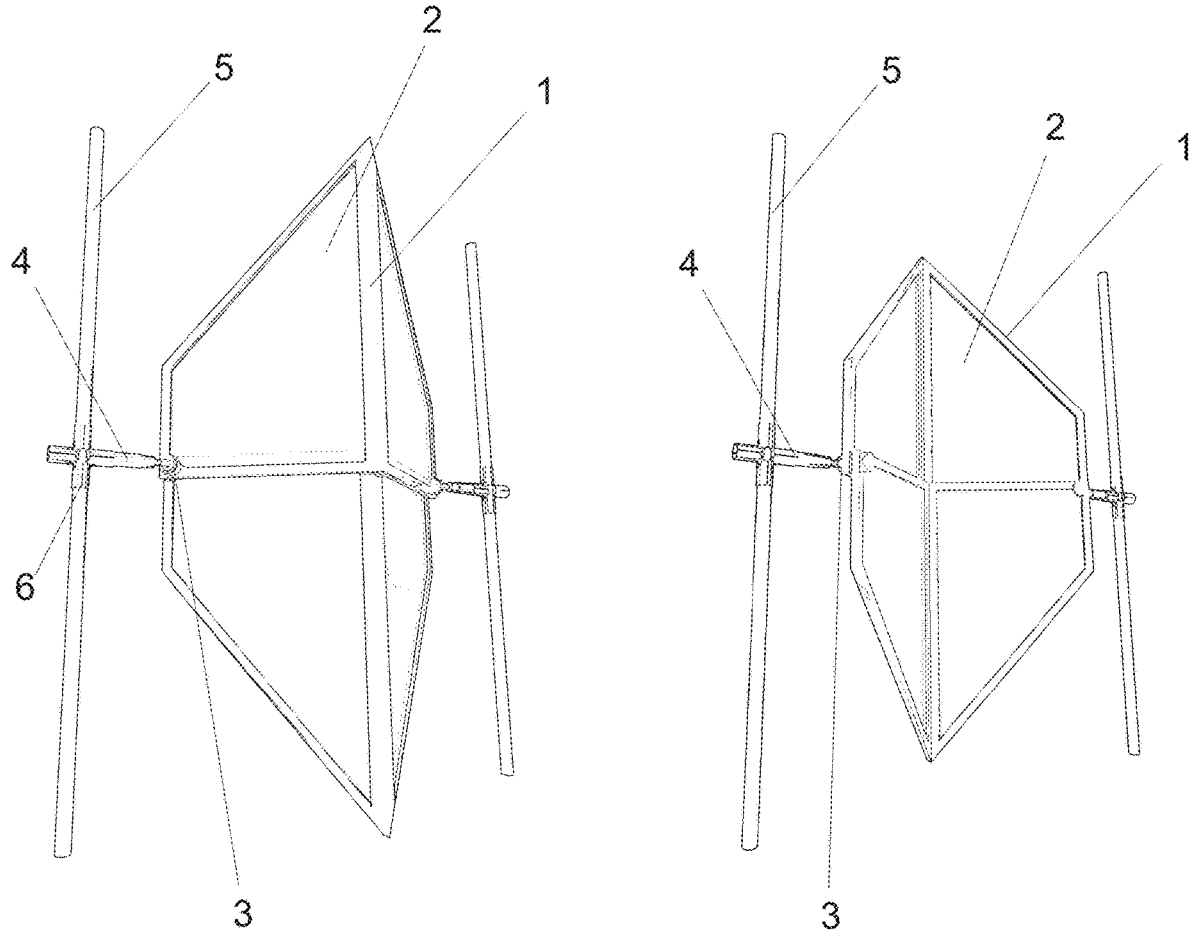
FIG. 3: The perspective view of the sound shield module of the system subject of the invention, at very high sound pressure.
Figure 4:
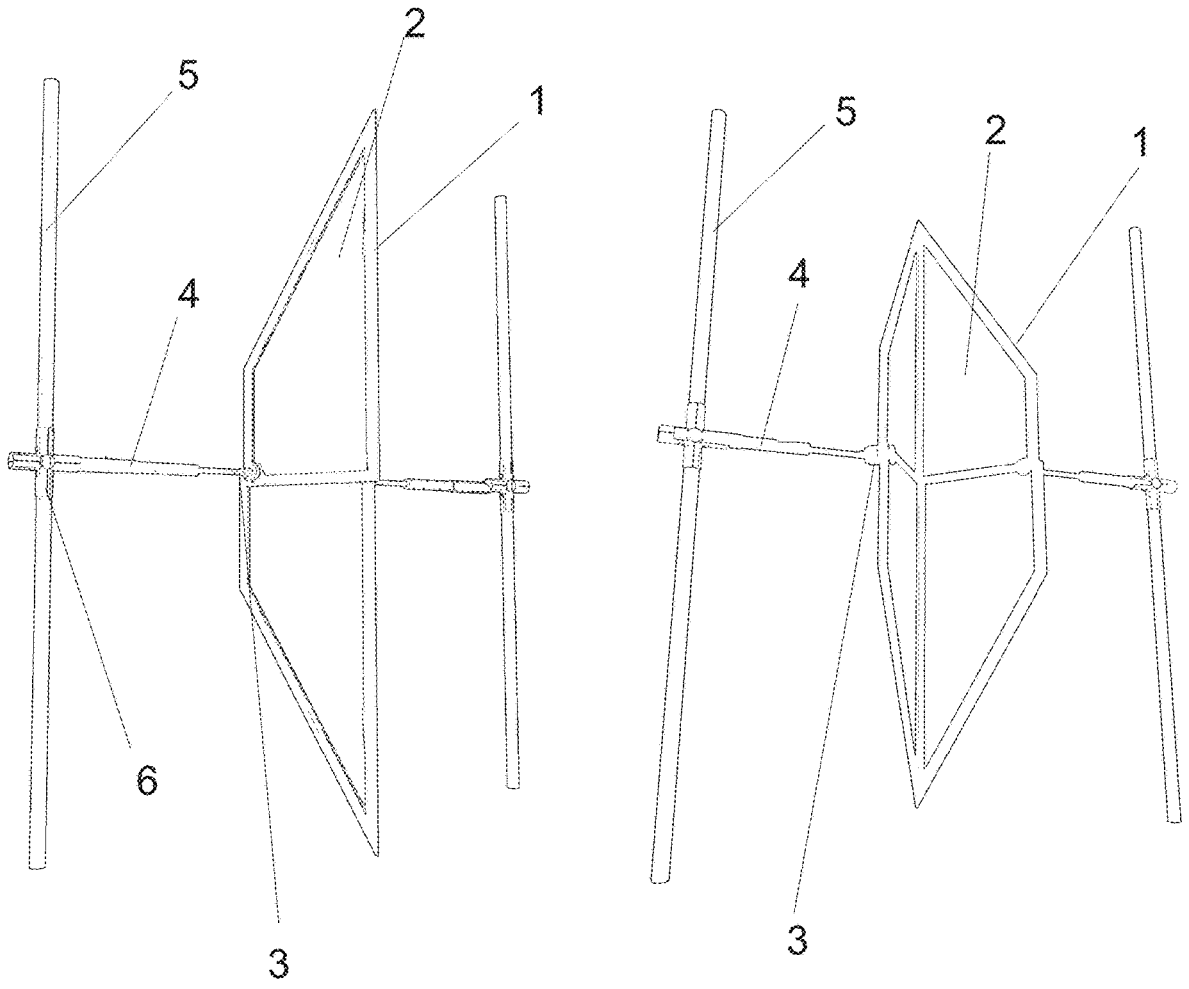
FIG. 4: The perspective view of the sound shield module of the system subject of the invention at high sound pressure.
Figure 5:
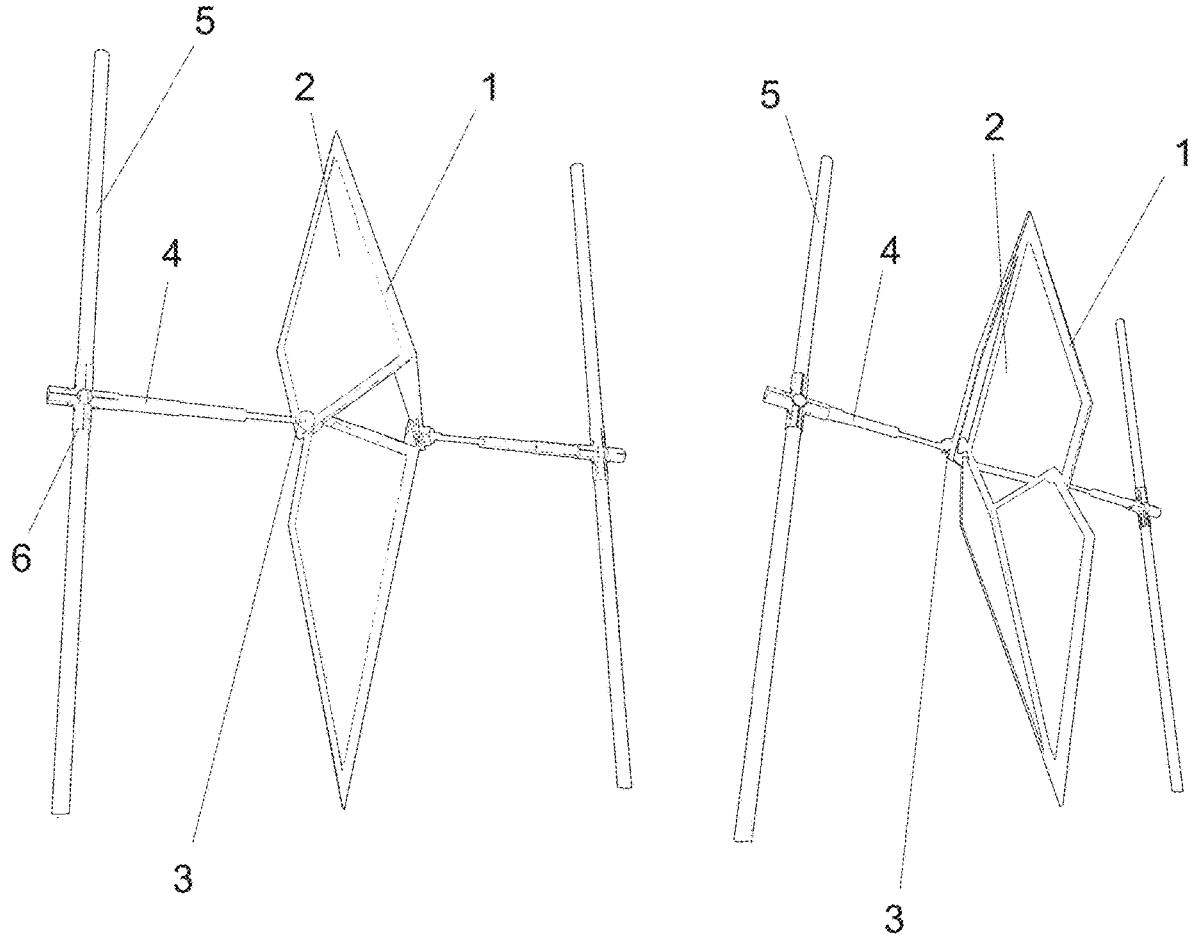
FIG. 5: The perspective view of the sound shield module of the system subject of the invention, at moderate sound pressure.
Figure 6:
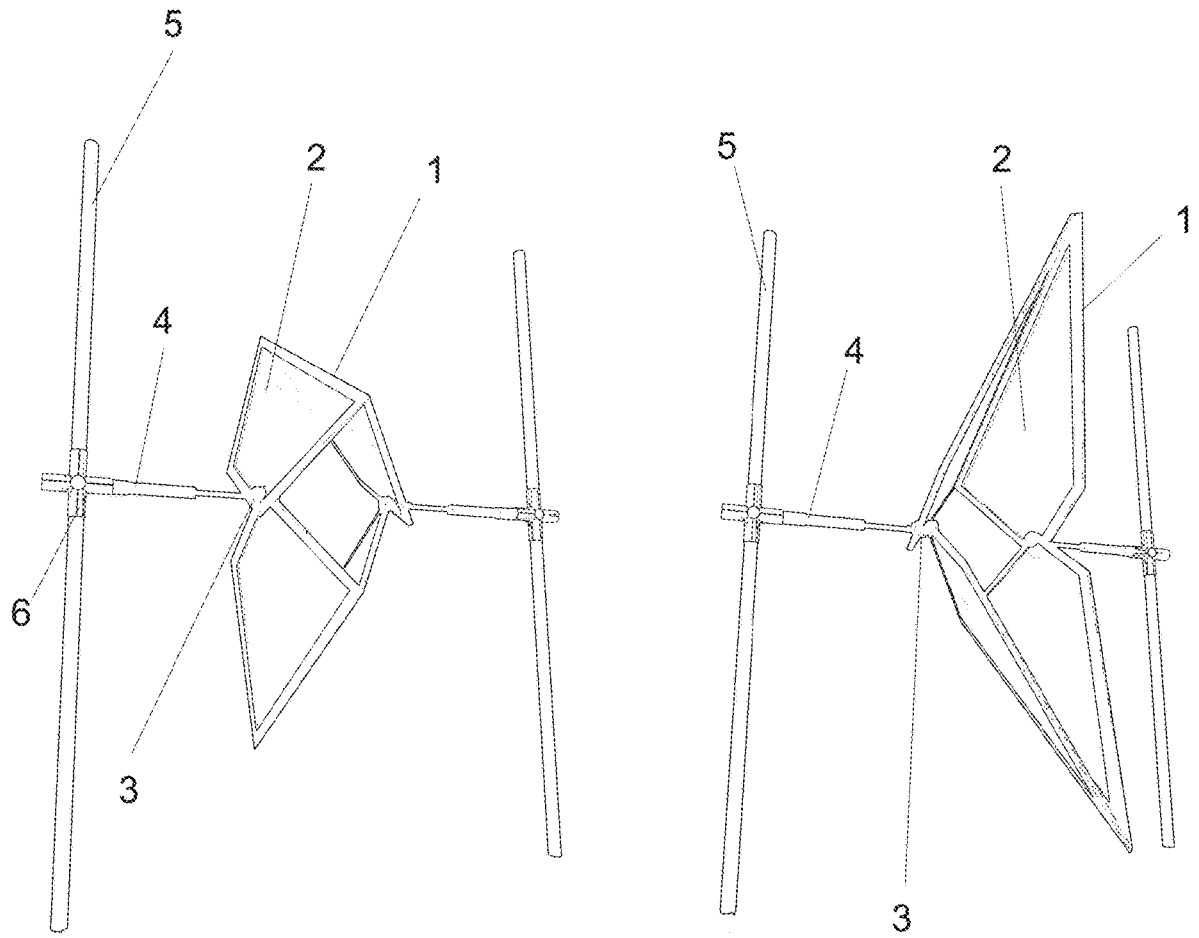
FIG. 6: The perspective view of the sound shield module of the system subject of the invention, at low sound pressure.
Figure 7:
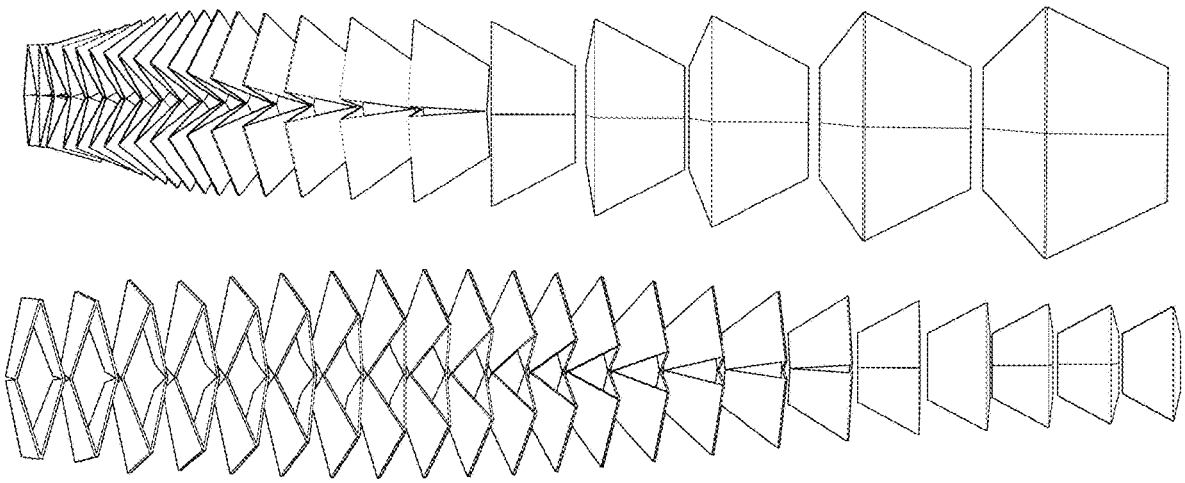
FIG. 7: The general view of the motion of the sound shield module of the system subject of the invention, according to sound pressure levels.
Figure 8:
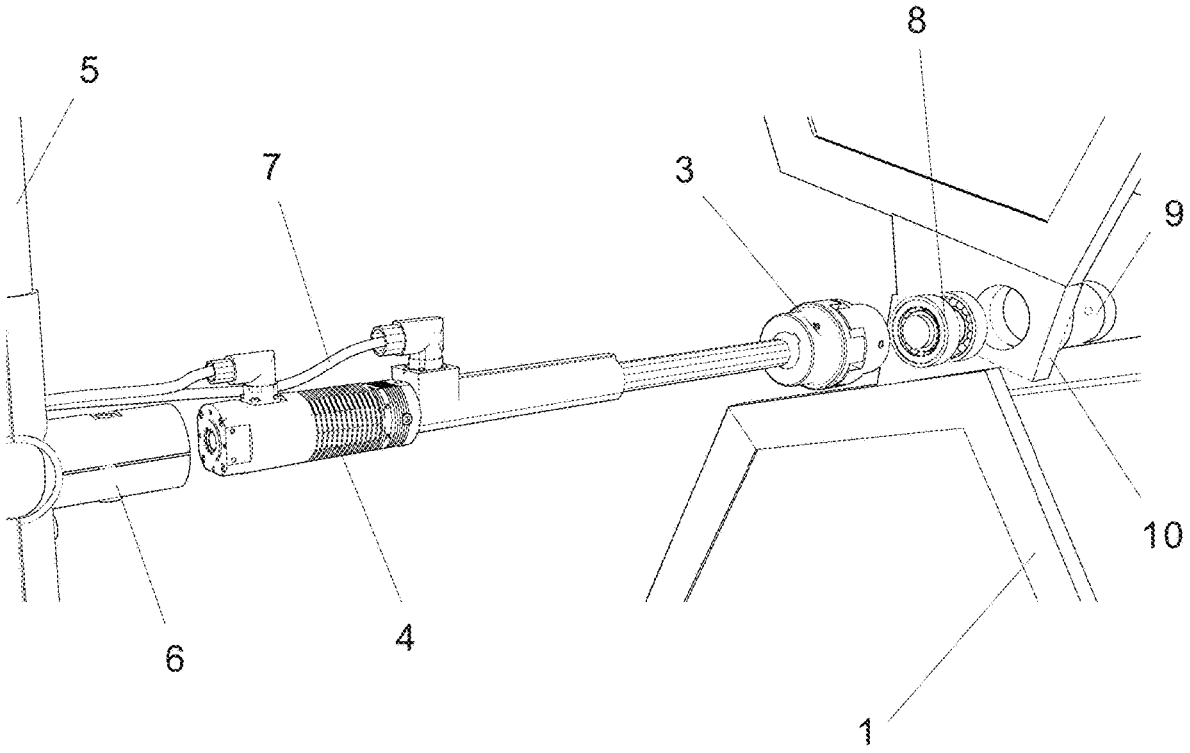
FIG. 8: The perspective view of the motion mechanism of the system subject of the invention.
Figure 9:
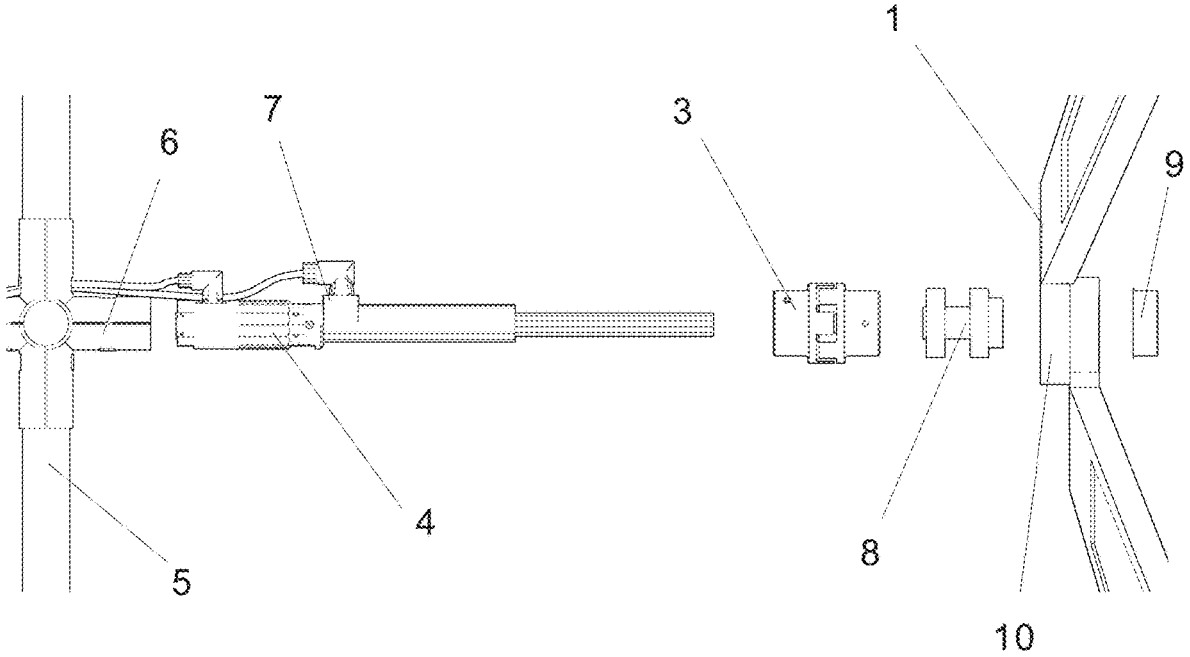
FIG. 9: The exploded view of the motion mechanism of the system subject of the invention.
Figure 10:
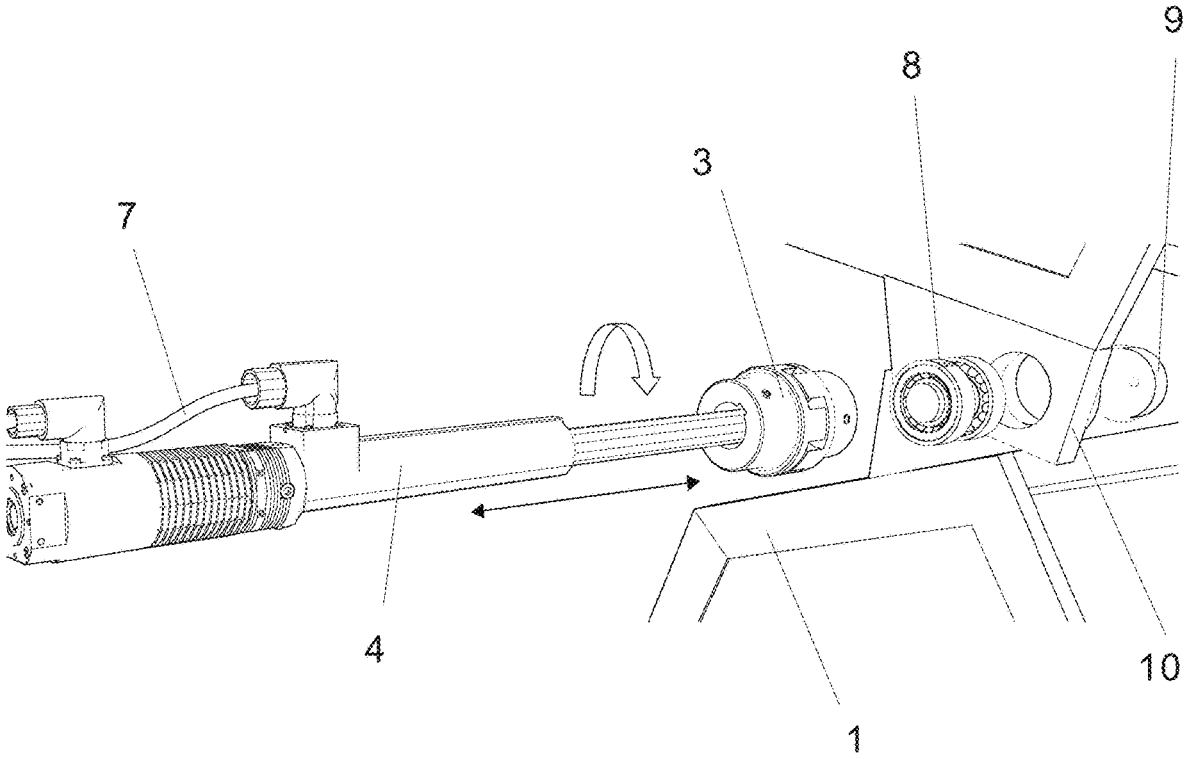
FIG. 10: The exploded perspective view of the facade module motion mechanism of the system subject of the invention.
Figures 11A, 11B:
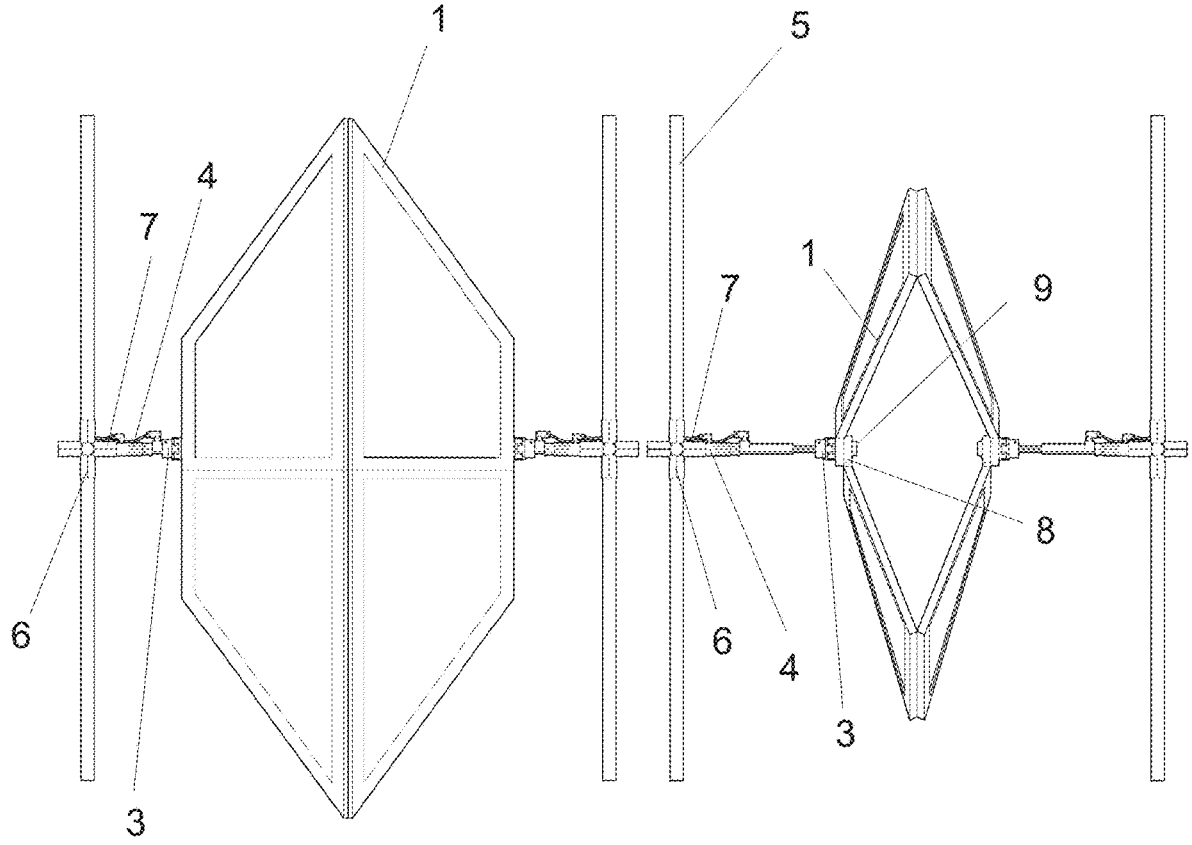
FIG. 11A: The general view of the pinions and the motion mechanism of the sound shield module of the system subject of the invention, under high sound pressure.
FIG. 11B: The general view of the pinions and the motion mechanism of the sound shield module of the system subject of the invention, under low sound pressure.
Figure 12:
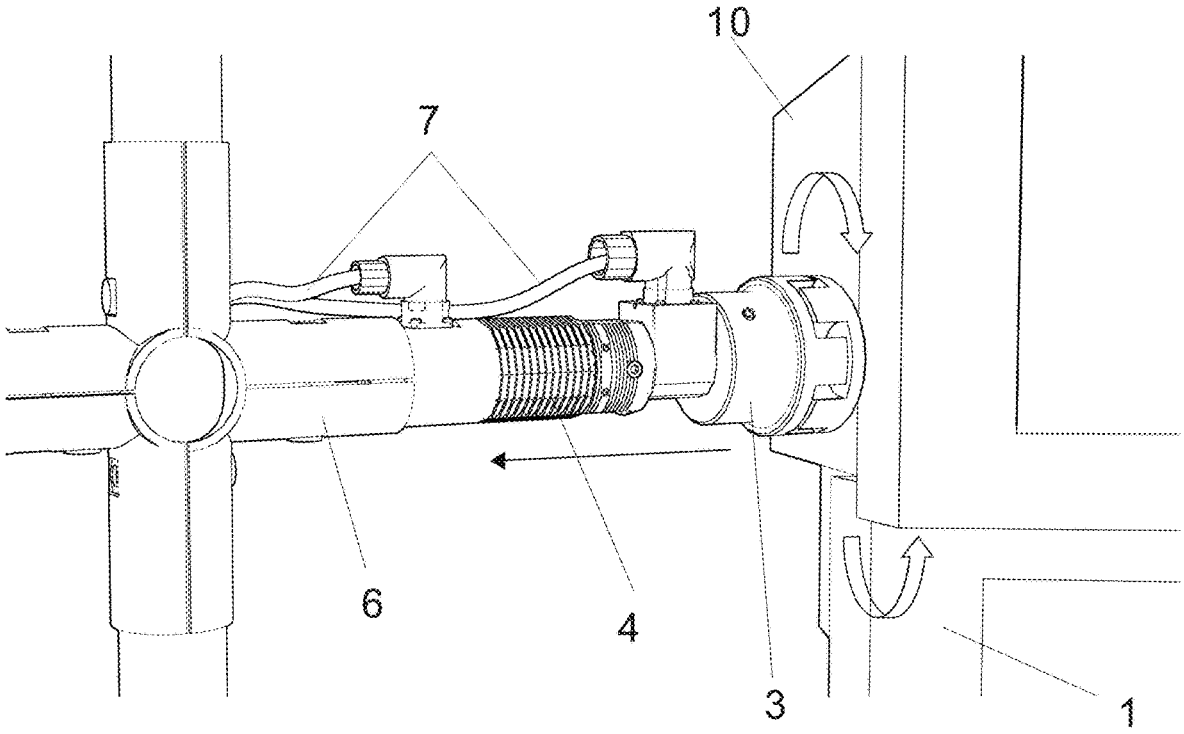
FIG. 12: The perspective view of the pinion, engine, and anchorage combination of the sound shield module of the system subject of the invention, at a high sound pressure level.
Figure 13:
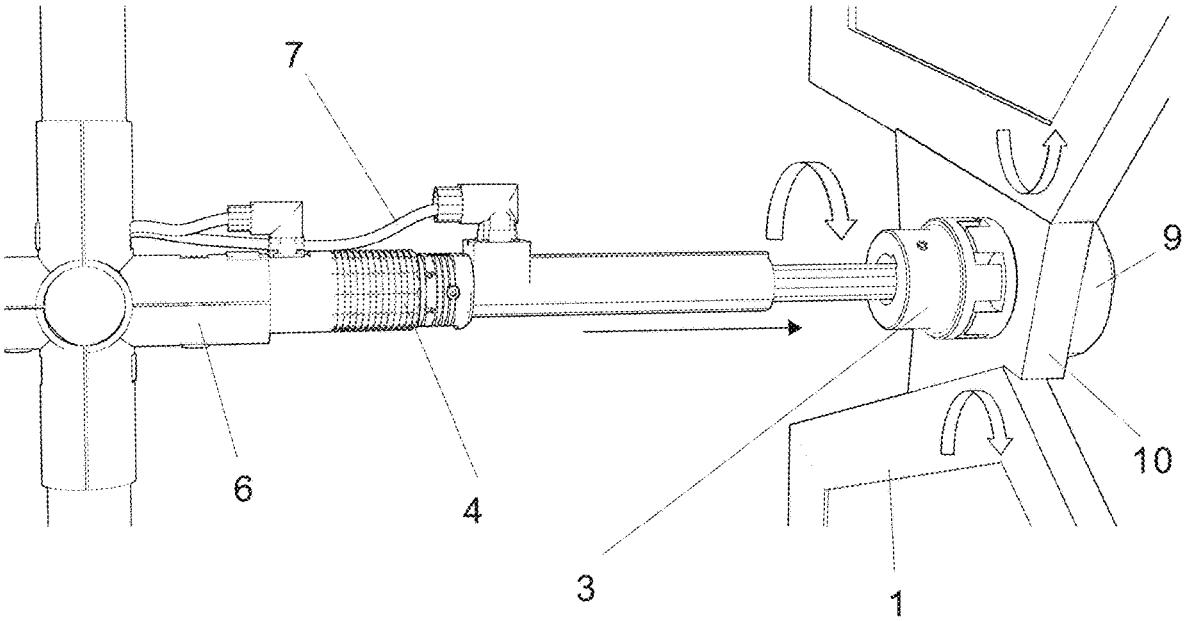
FIG. 13: The perspective view of the motion of the pinions and the motion mechanism of the sound shield module of the system subject of the invention, under low sound pressure.
Figure 15:
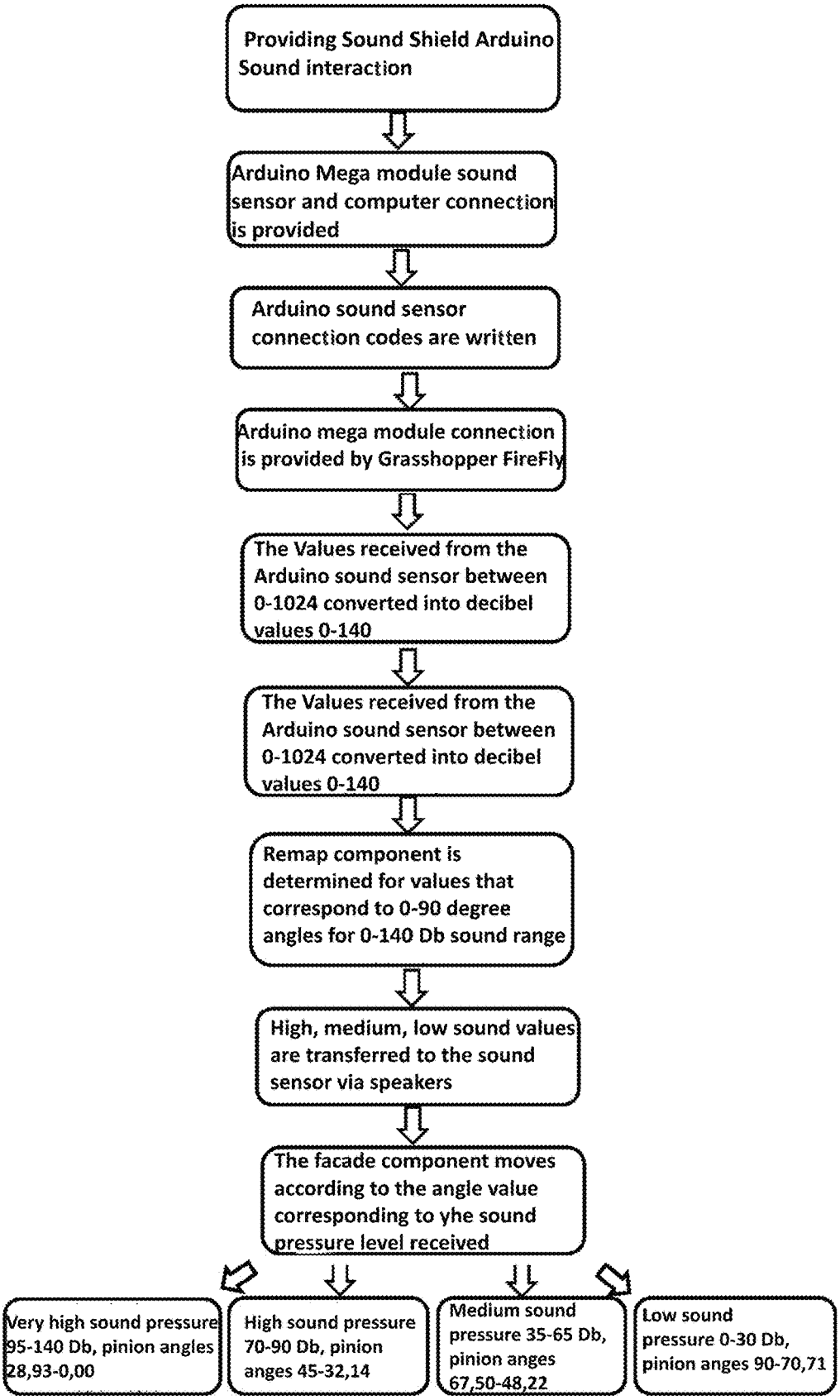
FIG. 15: The flowchart showing the interaction between the sound shield and Arduino in the system subject of the invention.
Figure 16:
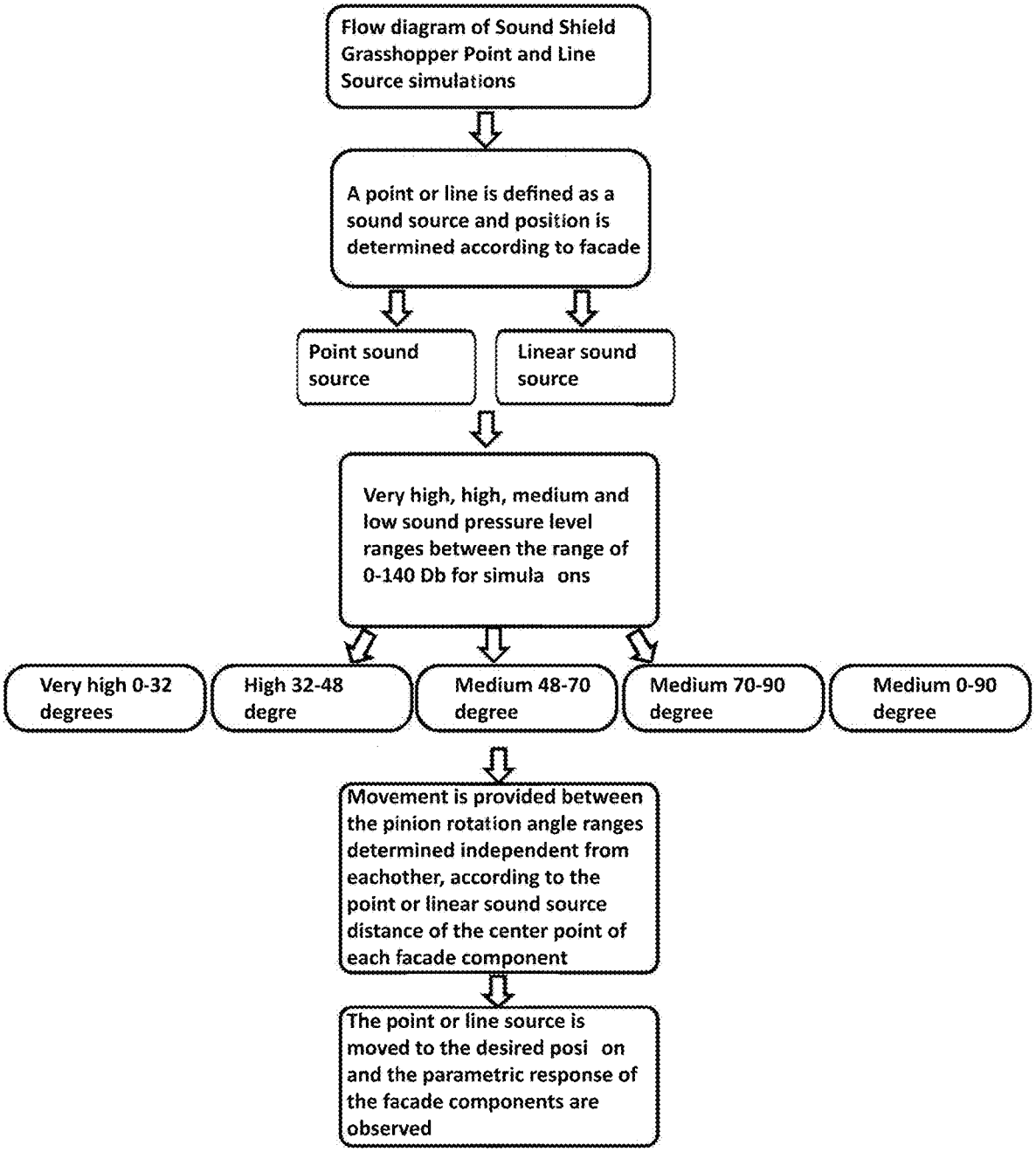
FIG. 16: The model flow diagram related to point and linear simulations made with grasshopper software, and the sound shield facade proposal of the system subject of the invention.

The parts in the figures have each been numbered, and the references to these numbers have been given below.

1. Steel frame structure
2. Coating material
3. Coupler
4. Servo motor
5. Vertical steel carrier profile
6. Vertical and horizontal steel carrier joint profile
7. Servo motor connection cable
8. Bearing
9. Bush cap
10. Pinion joint plate

DETAILED DESCRIPTION OF THE EMBODIMENTS

The system subject of the invention comprises,

The lightweight steel frame structure (1) where the module is mounted,

Translucent, lightweight coating material (2) with high acoustic value coated on the surfaces within the steel frame structure (1), Vertical steel carrier profile (5) enabling the sound shield modules to be anchored to the facade system, Coupler (3) that is the main connecting element of the pinion-motor located between the steel frame structure (1) and the vertical steel carrier profile (5), Servo motor (4) located between the coupler (3) and vertical steel carrier profile (5) enabling the rotation, linear push and pull motions of the module pinions, Vertical and horizontal steel carrier joint profile (6) connecting the vertical and horizontal steel profiles (5), Servo motor connecting cables (7) located between the coupler (3) and servo motor (4), Metal pinion joint plate (10) enabling the pinions to move, which connect the upper and lower pinions of the module, Bearing (8) located in the metal pinion plate (10) enabling the upper and lower pinions to fold 90 degrees backward, Bush cap (9) connected to the metal pinion plate (10) and the finishing element of the kinetic system mechanism.

The motion of the sound shield modules located on the structure (1) that is developed independently from the main structure on the existing facade, is coded to react to the rotating and folding motions, which surround sound between the 0-140 dB values, using the Grasshopper+Arduino software. Sound sensors have been provided on the designed module. The data detected via the sound sensor on the module are transferred to the computer environment, and they either enlarge the surface of the module to decrease the sound transition or close to balance the sound by decreasing the surface of the module, through the Grasshopper+Arduino software according to different sound pressure levels.

The sound shield module moving to obtain the maximum surface at high sound pressure levels closes by folding via the middle centerline, to obtain the minimum surface by closing the lower and upper pinions backward at low sound pressure levels.

The main structure of the facade modules (1), lightweight steel profiles (5), and coating material (2) are designed using translucent, semi-transparent acoustic material with high sound absorption. Sound receivers (7) and a servo motor (4) have been provided on each sound shield module. Thus, it can have independent kinetic motion and react more sensitively based on the factors affecting sound propagation, such as location and height. Six different parametric simulations, in which each facade component creates different facade patterns that vary according to the distance and intensity of the sound source, run on the Grasshopper software, to observe the operation of the system. The kinetic motion of the module as a result of the interaction between the point and linear sound sources was tested in the simulations, and it was observed that the facade gains a sound shield feature.

Acoustic simulations were performed using the sound maps and the location as basis to identify the noise-reducing ratio of the sound shield modules according to high surrounding sound using the Odeon sound acoustic software.

As a result of the simulations, it has been determined that it reduces the sound levels in high noise areas.

The measurements of the sound shield module can be changed to adapt to different building heights. The height of the construction of the facade element to be located on is 360 cm, and the horizontal length is 240 cm. The pinions, which are the fixed part of the facade component, are bent back 50 cm at an angle of 29°. The facade module is coded according to the direction and distance of the sound source. All the adaptive facade elements from the closest component to the farthest component can move independently in the direction of the identified kinetic system according to the sound pressure, as the sound source comes closer to the facade.

The lightweight coating material (2) is mounted to the lightweight steel frame structure (1). The upper and lower pinions and servo motor (4) are coupled to each other using the connecting element coupler (3) with the rotating mechanism. The coupler (3) joins the servo motors (4), enabling the module to be folded backward by pushing it. The servo motors (4) are mounted to the vertical and horizontal steel carrier joint profiles (6). The vertical and horizontal steel carrier joint profile (6) couples the main vertical and horizontal carrier steel profiles (5) of the system.

Sound receivers (7) have been provided on the sound shield module, and the system is connected to the servo motors (4), which maneuver to create the motion determined by detecting the sound level coded by using the Arduino+ Grasshopper software on the computer.

The decibel (dB) values of the module at different sound pressure levels are indicated below.

1st position of the module: Position at the very high sound pressure (between 90-140 dB), 2nd position of the module: Position at high sound pressure (between 65-90 dB), 3rd position of the module: Position at the medium sound pressure (between 30-65 dB), 4th position of the module: Position at the low sound pressure (between 0-30 dB), In the 1st position, the sound pressure level of the module is 90-140 dB, which is the highest noise value range. Servo motors (4) that move horizontally, are folded by one third with a range of 49°, reducing the surface width from 180 cm to 60 cm in the 2nd position of the facade module.

In the second position of the module, the servo motor (4) enables the module to fold by transmitting the rotation and push motions to the coupler (3) element as the numerical values of sound pressure decreases from very high to high. The opening between the right and left pinions of the component is 165 degrees at high pressure. The sound pressure level of the component is 65-90 dB, which is perceived as a high noise value range.

In the 3rd position, the servo motor (4) pushes the pinion-motor connection element coupler (3), and the pinion structures (1) start closing by turning backward when the opening between two pinions is 15 degrees. However, at medium sound pressure level, the upper and lower pinions fold backward from the rotating connection profiles (6) located at the point of junction, and opening is created between the upper and lower pinions of the component. In this case, the sound pressure level of the component is 30-65 dB, which is medium sound pressure level.

In the 4th position of the module, the servo motor (4) turns the pinion structure (1) 90 degrees and enables it to fold backward, when the environmental sound levels are at the lowest values. Hence, the module switches to the low sound mode by decreasing the surface. The width of the facade module is 60 cm. However, the upper and lower pinions of the component close by turning 90 degrees backward from the vertical and horizontal steel carrier joint profiles (6) located at the point of junction. In this case, the sound pressure level of the component is 0-30 dB, which is the low-level noise sound pressure value.

The servo motor (4) that is mounted to the vertical and horizontal steel carrier joint profile (6) element enables the linear motion and the rotation motion that enables the pinions to fold backward, according to the numerical sound values. It can have a rotary and linear actuator that provides precise control of position, velocity, and acceleration, angular or linear. The coupler (3) enables the power transfer and the connection to transfer the rotation motion to pinions from the servo motor (4). The bearing (8) element is located in the metal pinion plates (10). The bearing (8) enables the upper and lower pinions to move in different directions and reduces friction. The finishing element of the system that enables the upper and lower pinions to connect is the bush cap (9). The metal pinion plate (10) is anchored to the lightweight metal frame structure (1) steel frames for the system to work smoothly during the rotation motion of the upper and lower pinions of the motion system and to decrease the friction.

The sound pressure values coming from the sound receiver (7) and transforming into numerical values are coded as the rotation and push motions of the pinions using the Grasshopper software. The rotation and push motions of the servo motor (4) are transferred to the coupler (3) through these numerical values transmitted to the servo motor (4) via the servo motor connection cables (7). The motion transferred to the coupler (3) enables the backward closing by rotating the pinions to opposite directions via the bearing (8) located in the metal pinion plate (10). The metal pinion plate (10) anchor that is anchored steadily to the lightweight steel frame structure (1) pinion frame, enables the system to move in accordance with the motion transferred from the bearing (8).

The very high sound values that are between 95-140 dB are transmitted to the servo motor (4) via the sound receivers, and the pinions are pulled backward to enable the pinions to close by using the pulling movement coded using the Grasshopper software. The low sound values that are between 0-30 dB are transmitted to the servo motor (4) via the sound receivers (7). The low sound value rotation and push motion identified in the Grasshopper software are transmitted to the coupler (3) that transmits power and motion, the upper and lower pinions move backward as a result of the motion transmitted from the coupler (3) to the bearing (8), thus, enabling the pinions to fold backward to decrease the surface.

The location of the point sound source is identified in the layout plan for the simulation prepared for the present facade. The point sound source is located in the north direction and at the level of the ground floor, at the corner where the facade components that continue along 74 m height on the north-east and north-west sides connect. Very high sound pressure levels were taken into account as sound severity.

Sound Simulation Results

Facade sound maps were developed as a result of the sound simulations run for the 63 Hz-, 125 Hz-, 250 Hz-, 500 Hz-, 1000 Hz-, 2000 Hz- and 4000 Hz-centered octave bands (7-octave bands) for the present facade using the 1st position (maximum surface) and fourth situation (minimum surface) scenarios. Facade sound maps were evaluated using the color legend, explaining the sound pressure levels.

It was observed that the dynamic adaptive facade panels provide sound protection at the 500 Hz, 1000 Hz, 2000 Hz bands, which are audible to humans in the 1st and 4th position scenarios.

When the graphics of the results were compared, it was observed that the dynamic adaptive facade proposal applied, to the present facade decreased noise levels. The proposed facade system was observed as having the performance to decrease noise pollution, as a result of the real-time sound interaction run via the Arduino software, acoustic sound, and point and linear sound simulations on the sample facade via the Grasshopper software, and the sound analyses via the Odeon software.

In constantly changing and developing cities, the ability of the facades to adapt to the dynamic environments by transforming themselves against the increasing environmental problems will increase the performance of buildings and, therefore, the life quality of the cities.

What is claimed is:

1. A sound-data-interactive dynamic adaptive facade module system, comprising:

a steel frame structure, wherein a module is mounted to the steel frame structure, a coating material coated on surfaces inside the steel frame structure, a sound shield vertical steel carrier profile enabling sound shield modules to be anchored to the sound-data-interactive dynamic adaptive facade module system, a coupler, wherein the coupler is a main connection element of a pinion-motor, and the coupler is located between the steel frame structure and the sound shield vertical steel carrier profile, a vertical and horizontal steel carrier joint profile connecting vertical and horizontal steel profiles, a metal pinion plate enabling pinions to move, wherein the metal pinion plate connects upper and lower pinions of the module, a bearing enabling the upper and lower pinions to close 90 degrees backward, wherein the bearing is located in the metal pinion plate, and a bush cap, wherein the bush cap is a finishing element of a kinetic system mechanism, and the bush cap is connected to the metal pinion plate.

2. The sound-data-interactive dynamic adaptive facade module system according to claim 1, further comprising: a servo motor enabling the pinions to rotate, push and pull linearly, wherein the servo motor is located between the coupler and the sound shield vertical steel carrier profile.

3. The sound-data-interactive dynamic adaptive facade module system according to claim 2, further comprising: servo motor connection cables located between the coupler and the servo motor.

* * * * *